US008292097B2

(12) United States Patent
Goldberg

(10) Patent No.: US 8,292,097 B2
(45) Date of Patent: Oct. 23, 2012

(54) RING DISPLAY WITH RETRACTORS

(75) Inventor: Mark H. Goldberg, Davie, FL (US)

(73) Assignee: Lamar Creations, Inc., Helen, GA (US)

( * ) Notice: Subject to any disclaimer, the term of this patent is extended or adjusted under 35 U.S.C. 154(b) by 165 days.

(21) Appl. No.: 12/825,993

(22) Filed: Jun. 29, 2010

(65) Prior Publication Data

US 2010/0326934 A1 Dec. 30, 2010

Related U.S. Application Data

(60) Provisional application No. 61/221,203, filed on Jun. 29, 2009.

(51) Int. Cl.
*A47F 7/02* (2006.01)
*A47G 29/00* (2006.01)

(52) U.S. Cl. ..... 211/85.2; 211/59.3; 340/568.1; 206/566; 206/560; 206/565; 248/551

(58) Field of Classification Search ..... 211/85.2, 211/59.2, 59.3, 119.003, 183; 206/6.1, 560, 206/565, 566; 340/568.1–568.4; 24/3.13; 248/551, 552, 553
See application file for complete search history.

(56) References Cited

U.S. PATENT DOCUMENTS

| | | | | | |
|---|---|---|---|---|---|
| 331,780 | A | * | 12/1885 | Eising | 211/85.2 |
| 702,853 | A | * | 6/1902 | Angell | 206/560 |
| 886,608 | A | * | 5/1908 | Jersemann | 206/565 |
| 989,571 | A | * | 4/1911 | Dahl | 206/560 |
| 1,994,363 | A | * | 3/1935 | Kettendorf | 206/560 |
| 2,321,339 | A | * | 6/1943 | Wadsworth | 206/560 |
| 2,883,048 | A | * | 4/1959 | Lentz | 206/562 |
| 2,965,226 | A | * | 12/1960 | Ettlinger, Jr. | 206/564 |
| 3,170,571 | A | * | 2/1965 | Knapp et al. | 206/564 |
| D239,796 | S | * | 5/1976 | Williams | D6/466 |
| 4,074,637 | A | * | 2/1978 | Lorenzen, Jr. | 109/38 |
| 4,120,401 | A | * | 10/1978 | Newman | 206/566 |
| 4,156,484 | A | * | 5/1979 | Wischusen | 206/563 |
| 4,300,674 | A | * | 11/1981 | Davet | 206/6.1 |
| 4,486,169 | A | * | 12/1984 | Lewis | 431/253 |
| 4,917,235 | A | * | 4/1990 | Feiler | 206/6.1 |
| 5,062,526 | A | * | 11/1991 | Rudnick et al. | 206/6.1 |
| 5,312,000 | A | * | 5/1994 | Bass | 211/4 |
| 5,358,099 | A | * | 10/1994 | Tavone | 206/6.1 |
| D369,034 | S | * | 4/1996 | Davet | D6/457 |
| D370,371 | S | * | 6/1996 | Davet | D6/468 |
| 5,535,878 | A | * | 7/1996 | Reed | 206/6.1 |
| D379,410 | S | * | 5/1997 | Porcaro | D6/466 |
| 5,649,625 | A | * | 7/1997 | Ovadia | 206/566 |
| 5,685,436 | A | * | 11/1997 | Davet | 211/85.5 |
| 5,826,711 | A | * | 10/1998 | Ovadia | 206/6.1 |

(Continued)

*Primary Examiner* — Darnell Jayne
*Assistant Examiner* — Devin Barnett
(74) *Attorney, Agent, or Firm* — Thomas, Kayden, Horstemeyer & Risley, LLP.

(57) ABSTRACT

A display for displaying a plurality of rings with a display having a number of pockets in each of which a ring can be nested. Each pocket has an aperture in the bottom with a tether extending through the aperture for attachment to a ring with the other end being attached to a retractor secured to the display. The tether permits a person to examine the ring but not to remove it from the display. The retractor is preferably a spring loaded reel. Each pocket has a ramp on each side placed diagonally across for each other with a ramp stop for turning the ring into alignment with the pocket as the retractor pulls the ring into the pocket.

8 Claims, 7 Drawing Sheets

U.S. PATENT DOCUMENTS 6,039,496 A * 3/2000 Bishop ..... 403/4
6,932,212 B2 * 8/2005 Ovadia ..... 206/6.1
7,135,972 B2 * 11/2006 Bonato ..... 340/568.2
7,150,575 B1 * 12/2006 Minehart ..... 401/131
7,397,372 B2 * 7/2008 Perri et al. ..... 340/562
D575,556 S * 8/2008 Rohkar, Jr. ..... D6/466
7,714,722 B2 * 5/2010 Marszalek et al. ..... 340/568.2
2004/0104132 A1 * 6/2004 Ovadia ..... 206/6.1
2007/0023557 A1 * 2/2007 Rankin ..... 242/381
2007/0152819 A1 * 7/2007 Marszalek et al. ..... 340/568.4
2007/0251903 A1 * 11/2007 High ..... 211/85.2

* cited by examiner

RING DISPLAY WITH RETRACTORS

CROSS-REFERENCE TO PENDING APPLICATIONS

This application is a utility application that claims priority to U.S. Provisional Patent Application entitled, "Retractable Ring Display", having Ser. No. 61/221,203 filed Jun. 29, 2009, and co-pending U.S. Design Patent Application entitled, "Display for Rings", having Ser. No. 29/343,055 filed Sep. 4, 2009, which are entirely incorporated herein by reference.

FIELD OF THE INVENTION

The present invention discloses a display with a number of pockets for displaying rings, or other pieces of jewelry, with each ring being attached to a retractable tether. A retractable tether is attached to prevent the ring's removal from the display. The tether allows the ring to be examined by a person, but it can not be removed far from the display.

BACKGROUND OF THE INVENTION

One of the problems in displaying jewelry, such as rings, is that they can be easily removed and stolen by a customer unless the ring is under tight control. It would be desirable to have a display where a customer could look at a number of rings at the same time and examine them up closely in his or her hands, but not be able to detach them from the display.

SUMMARY OF THE INVENTION

This invention is a display with a plurality of ring holders, each having a pocket for displaying a ring, each of which is attached to a retractable tether. The tether is basically a line that is attached to each ring and to a spring loaded reel on the underside of the display to automatically retract the ring into the pocket after a customer has finished examining the ring. Each pocket is provided with a ramp and ramp stop on each side of the pocket to automatically guide and neatly seat the ring in the recess in the pocket so it is attractively displayed to customers. In order to properly align the ring with the pocket the ramps are located diagonally across the pocket from each other and the ramp stops are also located across from each in the middle section of the pocket. Preferably the stops are located slightly diagonally across from each other. The ring is aligned with the pocket by it being pulled up the ramps away from the ramp stops by the tether. The ring is turned in either a clockwise or counter-clockwise direction depending on the arrangement of the ramps and ramp stops on the sides of the pocket.

DESCRIPTION OF THE INVENTION

The display of this invention is designed and capable of displaying a plurality of rings or other pieces of small jewelry in pockets. Each ring is attached to a retractable tether so that a customer may pull the ring a certain distance from the display for more careful inspection. When the customer releases the ring it will be automatically retracted into a pocket in the display.

Parts List

Figure 1:
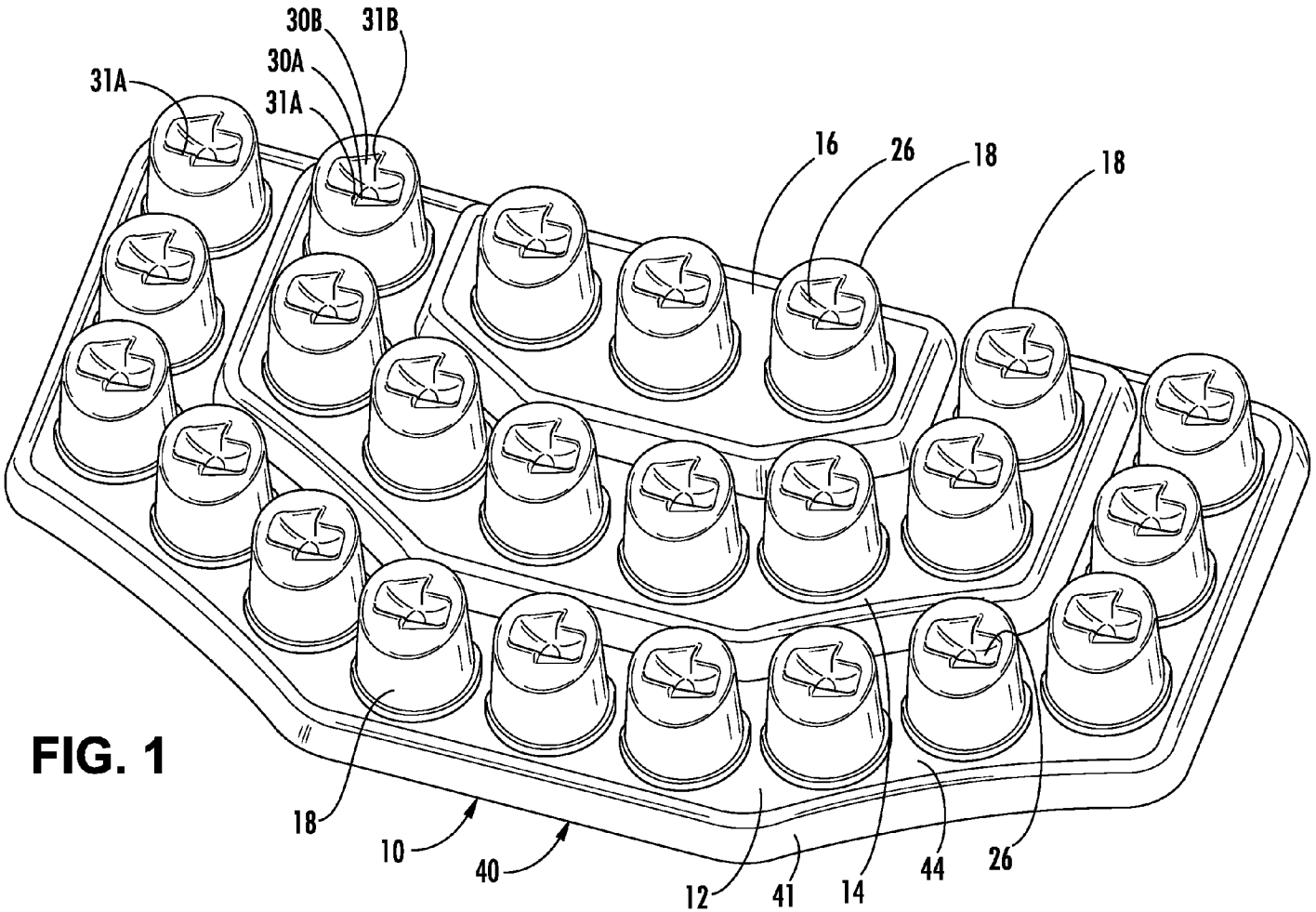
FIG. 1 is a perspective view of the top of the display with pockets for displaying rings.
Figure 2:
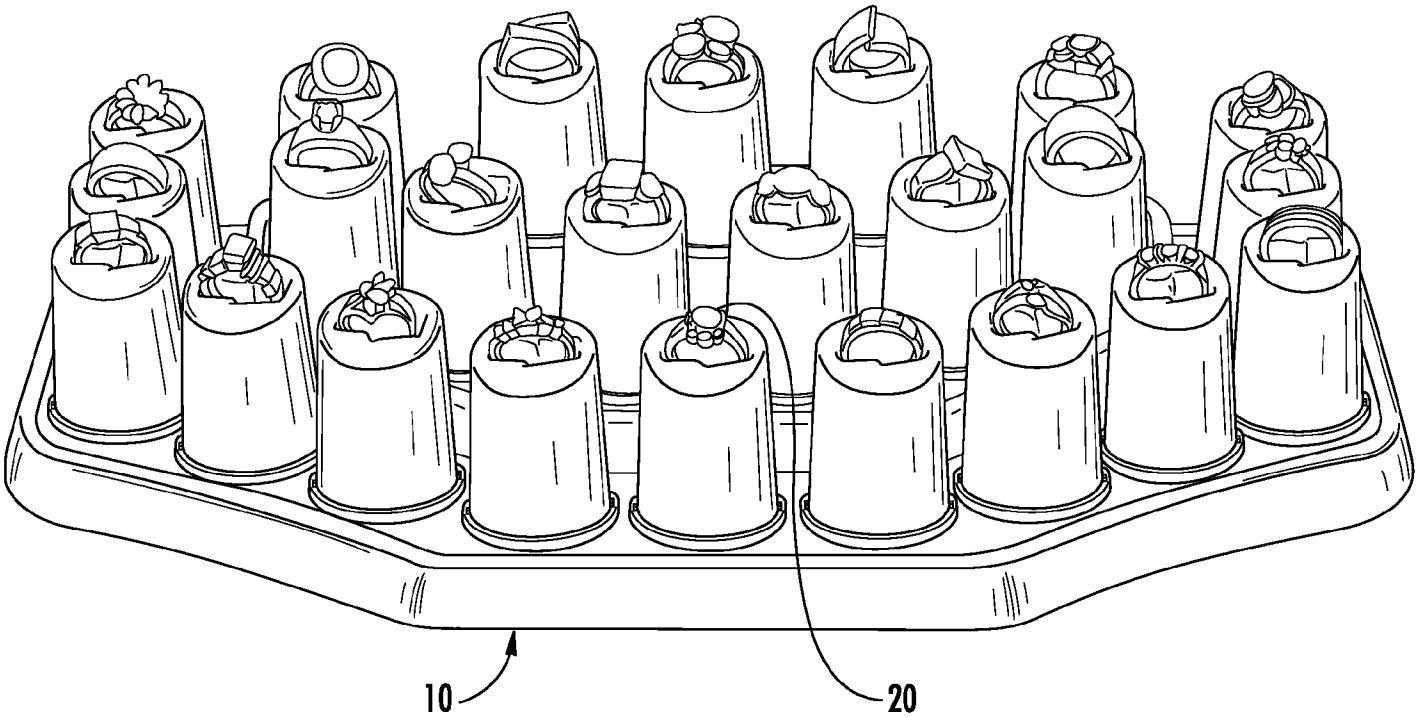
FIG. 2 is a perspective view of the top of the display with a ring nested in the recess of each pocket.
Figure 3:
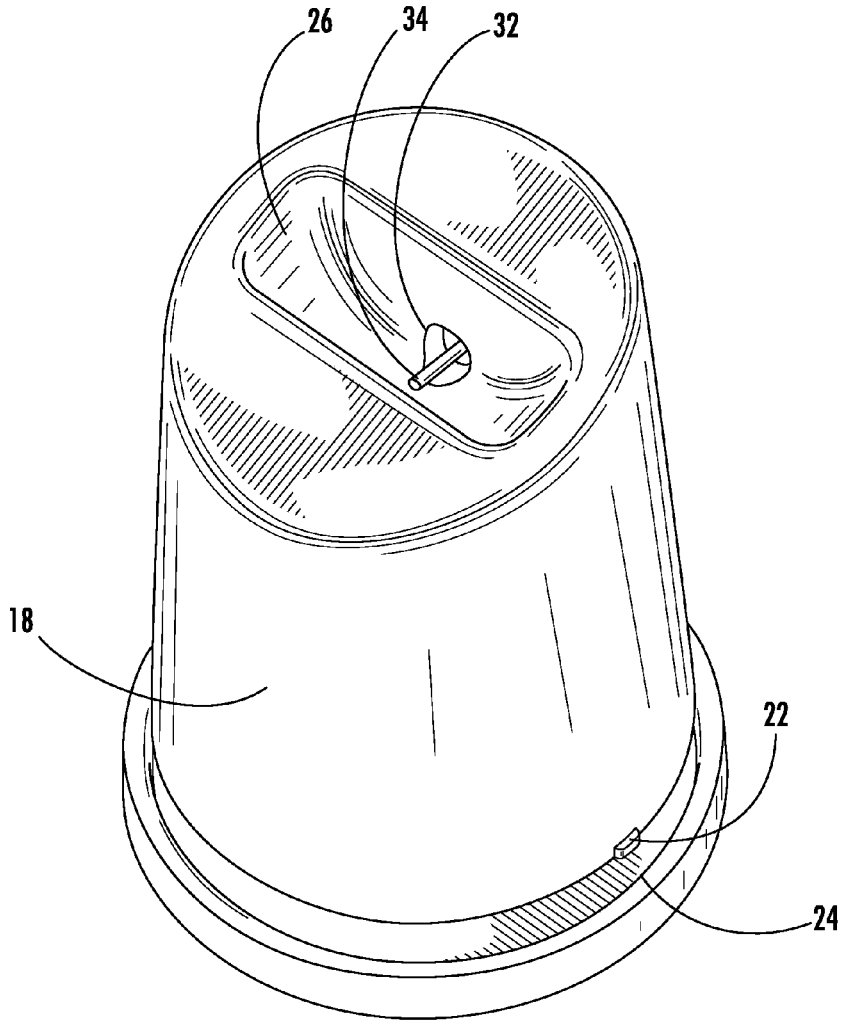
FIG. 3 is a perspective view of a single ring holder with a pocket in which a ring can be displayed.
Figure 4:
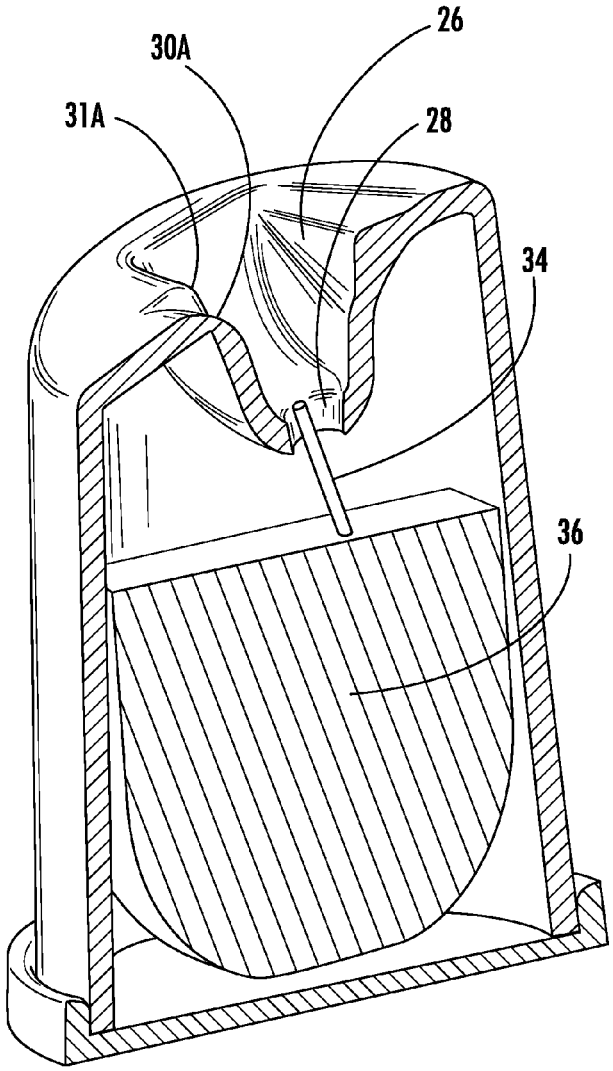
FIG. 4 is a cross section of a ring holder showing the pocket and retractor in place.
Figure 5:
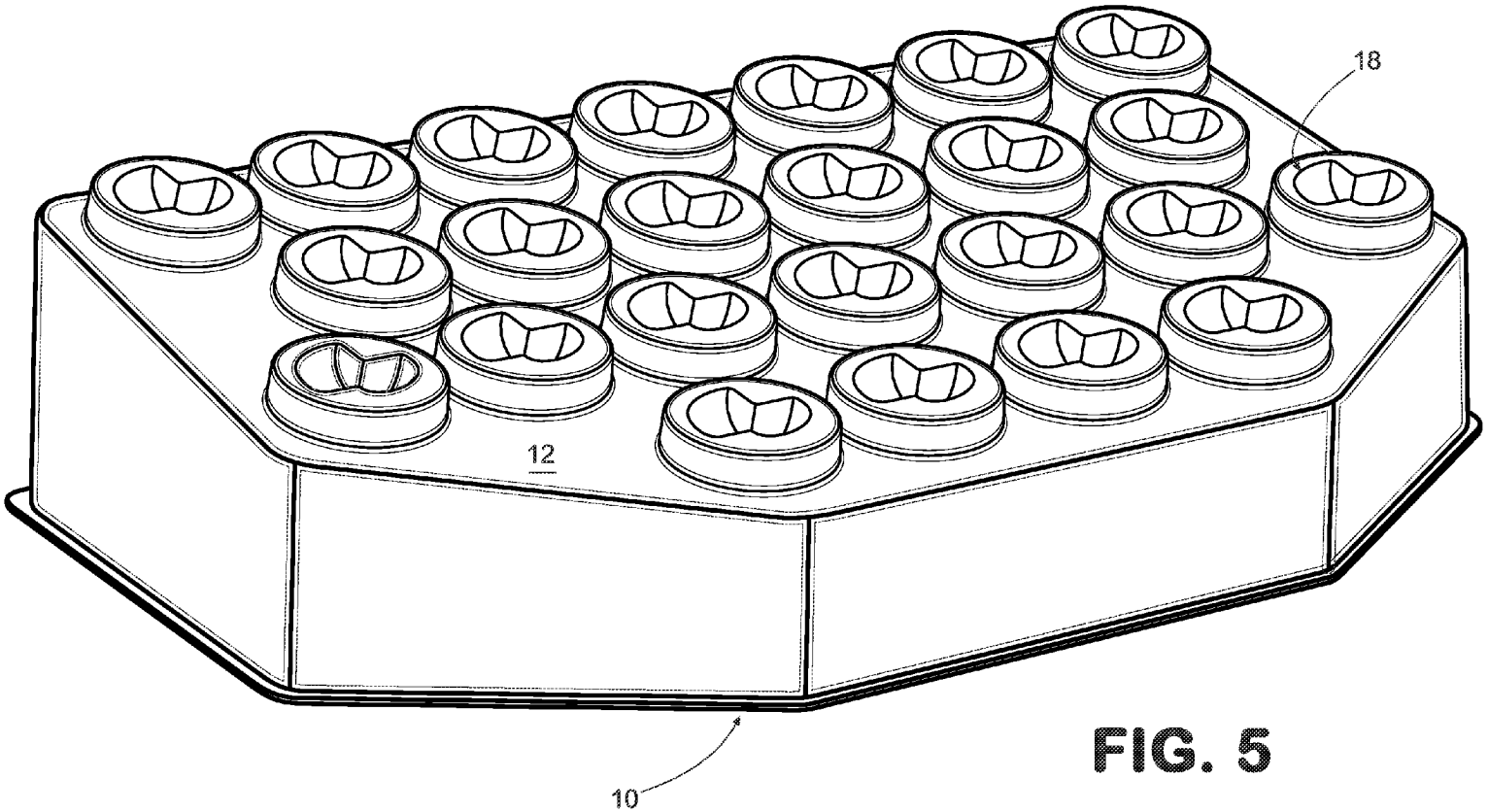
FIG. 5 is a perspective view of the top of the display with pockets with one type of ramp and ramp stop for use in nesting rings in the recess of a pocket on the display.

10=Display
12=Outside top of display
14=Middle top of display
16=Inside top of display
18=Ring holder
20=Ring
22=key
24=Locking slot
26=Ring Pocket
28=Recess
30A-D=Entryway ramp
31A-D=Ramp stop
32=Aperture
34=Tether
36=Spring loaded reel
38=Clamp
40=Front of display
42=Base of display
44=Top of display
46=Slot in spring loaded reel
48=Coil spring in reel
50=Spool in reel The ring display 10 of this invention is shown in FIGS. 1 and 2. This display has a bottom layer 12 which is an outside top of the display 10. Elevated above it a slight distance is the middle top 14 of the display 10 and above it is the inside top 16 of the display. By having the rings displayed at different levels it is easier for a prospective customer to see the rings from the front 40 of this display 10. The display 10 can be constructed of any suitable material such as a molded plastic like polystyrene or ABS. The display can be vacuum formed. The display 10 has a number of ring holders 18 which are designed to hold and display rings 20. This ring holder 18 can be molded out of a separate piece of plastic from the base 42 of the display 10 as shown in FIG. 3. The ring holder 18 can extend a considerable distance above the top 44 of display as shown in FIG. 1 or only be a short distance above the display as shown in FIG. 5. A key 22 can be molded onto the bottom of the ring holder 18 for locking into a locking slot 24 in the top 44 of the display 10. This ring holder has a ring pocket 26 with a recess 28 at the bottom of the pocket in which a ring 20 can be nested so that any jewel on the ring will be displayed when the ring is nested in the recess 28. The pocket 26 and recess 28 are designed so that any jewel on the ring would be displayed above the plane of the top of the ring holder as illustrated in FIG. 2. A ring 20 is held in the recess 28 of the ring pocket 26 by a tether 34, which may be constructed of metal or plastic wire. The tether 34 extends through an aperture 32 in the ring holder 18 and is attached to a spring loaded reel 36 as shown in FIG. 4. The tether 34 extends through the ring and is secured to itself by a suitable clamp 38 as shown in FIG. 8.

The spring loaded reel 36 has a slot 46 through which the tether 34 passes, a coil spring 48 and a spool 50 around which the tether 34 is wound. A retractor manufactured by the Vulcan Spring Company is preferred. Other types of retractors may be used.

Figure 6:
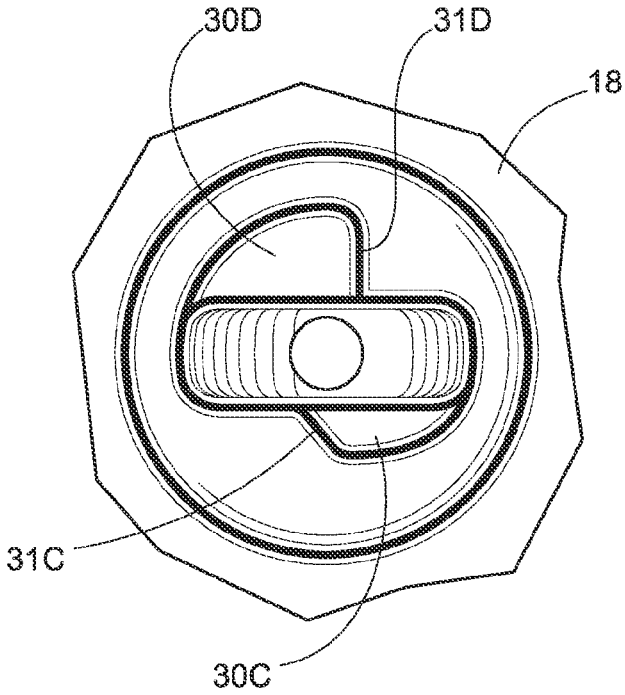
FIG. 6 is top view of a pocket with one type of ramp and ramp stop for use in nesting rings in the recess of a pocket on the display.
Figure 7:
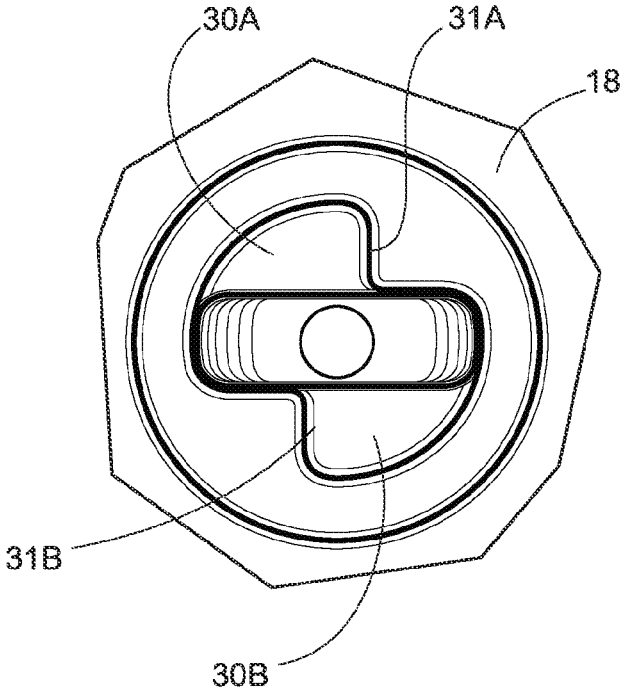
FIG. 7 is a top view of a pocket with another type of ramp and ramp stop for use in nesting rings in the recess of a pocket on the display.

Since the ring is attached to a tether 34 which in turn is attached to a spring loaded reel 36 or retractor, a customer can pull the ring 20 some distance away from the display 10 for viewing. When the customer releases the ring 20, the spring loaded reel 36 automatically pulls it back to nest in the recess 28 of the ring pocket 26. This retraction and nesting occurs automatically once a customer releases the ring 20. A ring is automatically guided into the nested position in the recess 28 by entryway ramps 30 A-D and ramp stops 31A-D on the side of each pocket 26. One type of entryway ramp is shown in FIG. 6 in which case the ramp stops 31C & D on each side of the pocket 26 are not set directly across from each other and ramp 30D is considerable larger than ramp 30C. Another type of ramp is illustrated in FIG. 7 where the ramps 30A and 30B are of the same size. These ramps 30A-D allow for and force the ring 20 to turn so it can nest in the recess 28. The ramp stops 31A-D force the ring 20 the slide up the ramp 30A-D and nest in the recess 28. The ramps are constructed diagonally across from each as illustrated by FIG. 7 where ramp 30A is diagonally across from ramp 30B. In this arrangement the ring 20 is turned counter-clockwise. It is preferred that the ramp stops be offset slightly from each other as shown in FIG. 7 by ramp stop 31A and 31B so the ring is not hung up across the center of the pocket 26.

Figure 8:
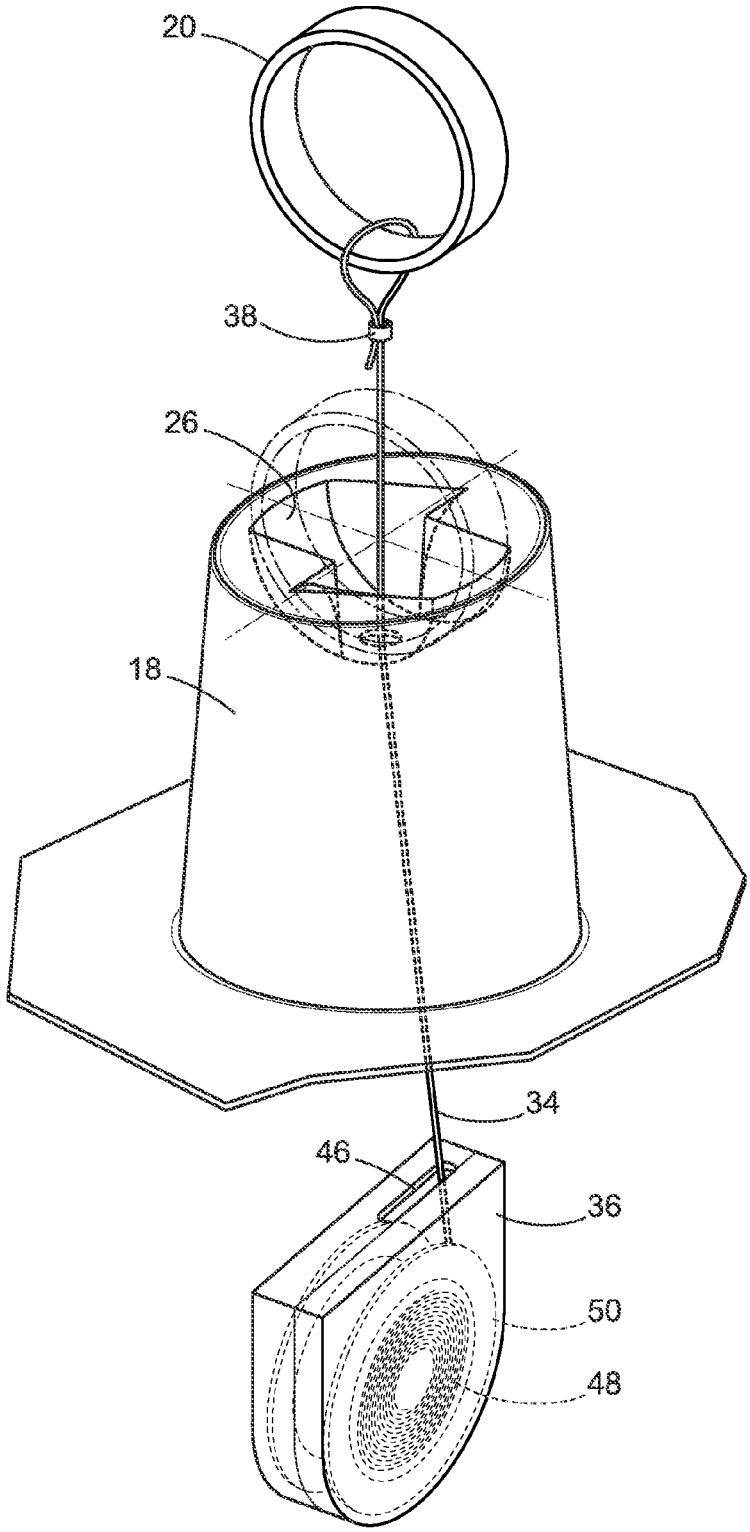
FIG. 8 is view of the ring holder with the retractor removed showing the mechanism of the retractor.

FIG. 8 shows the ring 20 having been removed from the recess 28 for examination. Even if a person does not carefully put the ring 20 back into the recess and simply releases the ring, the tether 34 will pull the ring back into the pocket 26 and the ramps 30A-C and ramp stops 31A-B will draw the ring into a proper nesting position in the recess 28. The depth of the pocket 16 and the recess 28 is arranged so that any jewels on the ring 20 will be clearly visible as shown in FIG. 2.

While this is display 10 can be constructed out of a single piece of plastic by vacuum forming or otherwise, it can be constructed in sections and put together. It is possible to mold the display and the ring holders having pockets as a single piece. Preferably the ring sockets 26 are molded separately by extrusion molding and installed in openings in the display 10. The drawings show the spring loaded reel 36 lodged into the ring holder 18; however, the spring reel could be placed in a different location.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

I claim:

1. A display for displaying a plurality of jewelry rings, each of which has a back and face with a jewel or other ornamentation on the face, or other similar pieces of jewelry, said display having a top with a plurality of ring holders extending up from the top, each of the ring holders having a top, with each ring holder having a pocket with a bottom recess, in each of which a ring can be nested with the back of the ring resting in bottom recess, with each pocket having a depth from the top of the ring holder so that the face of the ring can be located above the top of the ring holder for display when the ring is resting in the recess, each pocket having a bottom section in which an aperture is located with a tether extending through the aperture for attachment to the ring, the aperture in the bottom section of the pocket being slightly larger than the diameter of the tether, said display having a retractor to which the other end of the tether is attached, the retractor being secured to the display, said retractor will pull the tether so the ring is secured in the pocket when the ring is released by someone examining the ring, the tether and retractor preventing someone from taking the ring from the display, with each pocket having a middle section and two sides with a ramp and a ramp stop on each side of the pocket on the top of the ring holder, with the ramp stops being located across the pocket from each other in the middle section, and each ramp extending from the top of the ring holder towards the bottom of the pocket to the ramp stop, with each ramp located diagonally across from each other, so the tether pulls the ring into proper alignment in the pocket by pulling the ring up the ramp away from the ramp stop which turns the ring so it is in proper alignment to enter the pocket and recess in the pocket when the ring is released.

2. The display of claim 1 in which the ramp stops are located diagonally across from each other.

3. The display of claim 1 in which the display and ring holders with pockets are constructed from a single piece of material and the retractors are attached to the ring holders.

4. The display of claim 1 in which the retractors are spring loaded reels and the tethers are constructed of metal or plastic wire.

5. The display of claim 1 in which the top of the display has a plurality of openings into which the ring holders are inserted and attached to the display.

6. The display of claim 1 which has a back and front where customers can view the rings, said display having at least two tiers with the plurality of ring holders extending from the front to back, with the ring holders having a higher top from the front to back of the display for ease of viewing by customers.

7. A display for displaying a plurality of jewelry rings, each of which has a back and face with a jewel or other ornamentation on the face, or other similar pieces of jewelry, said display having a top with a plurality of ring holders extending up from the top, each of the ring holders having a top, with each ring holder having a pocket with a bottom recess, in each of which a ring can be nested with the back of the ring resting in bottom recess, with each pocket having a depth from the top of the ring holder so that the face of the ring can be located above the top of the ring holder for display when the ring is resting in the recess, each pocket having a bottom section in which an aperture is located with a tether extending through the aperture for attachment to the ring, the aperture in the bottom section of the pocket being slightly larger than the diameter of the tether, said display having a retractor to which the other end of the tether is attached, the retractor being secured to the display, said retractor will pull the tether so the ring is secured in the pocket when the ring is released by someone examining the ring, the tether and retractor preventing someone from taking the ring from the display, with each pocket having a middle section and two sides with a ramp and a ramp stop on each side on the top of the ring holder, with the ramp stops being diagonally located across the pocket from each other in the middle section, and each ramp extending from the top of the ring holder towards the bottom of the pocket to the ramp stop, with each ramp located diagonally across from each other, so the tether pulls the ring into proper alignment in the pocket by pulling the ring up the ramp away from the ramp stop which turns the ring so it is in proper alignment to enter the pocket and recess in the pocket when the ring is released.

8. The display of claim 7 in which the ring holders are constructed separately and are attached to and extend up from the top of the display.

* * * * *